US007461757B2

(12) United States Patent
Lipson

(10) Patent No.: US 7,461,757 B2
(45) Date of Patent: Dec. 9, 2008

(54) BEVERAGE CONTAINER WITH SELF-RETENTIVE STRAW

(76) Inventor: Erik Lipson, 530 S. Second St., GU-11, Philadelphia, PA (US) 19147

( * ) Notice: Subject to any disclaimer, the term of this patent is extended or adjusted under 35 U.S.C. 154(b) by 445 days.

(21) Appl. No.: 10/424,323

(22) Filed: Apr. 28, 2003

(65) Prior Publication Data

US 2004/0245257 A1 Dec. 9, 2004

(51) Int. Cl.
*A47G 19/22* (2006.01)

(52) U.S. Cl. ..... 220/705; 220/703; 220/709; 215/388

(58) Field of Classification Search ..... 220/703, 220/705, 709, 710; 215/388
See application file for complete search history.

(56) References Cited

U.S. PATENT DOCUMENTS

| | | | | | |
|---|---|---|---|---|---|
| 2,052,496 | A | * | 8/1936 | Stassi | 215/229 |
| 3,517,884 | A | * | 6/1970 | Horvath | 239/33 |
| 3,729,136 | A | * | 4/1973 | Friedman | 239/33 |
| 4,576,336 | A | * | 3/1986 | Cohen et al. | 239/33 |
| 4,735,329 | A | * | 4/1988 | Le | 215/229 |
| 4,923,083 | A | * | 5/1990 | Forbes | 220/705 |
| 5,021,019 | A | * | 6/1991 | Gandy | 472/52 |
| 5,105,956 | A | * | 4/1992 | Tarng-Lin | 215/11.1 |
| 5,211,298 | A | * | 5/1993 | Bloch | 215/11.1 |
| D339,961 | S | * | 10/1993 | Ravelo et al. | D7/515 |
| 5,439,125 | A | * | 8/1995 | Bloch | 215/229 |
| 5,598,945 | A | * | 2/1997 | Gracy | 220/707 |
| D389,365 | S | * | 1/1998 | Lipson | D7/300.2 |
| D412,423 | S | * | 8/1999 | Lipson | D7/300.2 |
| D430,986 | S | * | 9/2000 | Lipson | D7/300.2 |
| 6,193,101 | B1 | | 2/2001 | Murphy et al. | 220/706 |
| 6,230,913 | B1 | * | 5/2001 | Cornell et al. | 215/387 |
| 6,264,057 | B1 | * | 7/2001 | Kim | 220/706 |
| 6,336,566 | B1 | | 1/2002 | Lipson | 215/388 |
| 6,550,631 | B2 | * | 4/2003 | Thompson | 220/709 |

* cited by examiner

*Primary Examiner*—Anthony D Stashick
*Assistant Examiner*—Christopher B McKinley
(74) *Attorney, Agent, or Firm*—Gifford, Krass, Sprinkle, Anderson & Citkowski, P.C.

(57) ABSTRACT

The invention provides a straw and beverage container combination wherein the straw has retention means such as a convoluted portion adjacent one end that resists removal of the straw from the central aperture of the container lid when a lid is attached to the container. The means also serve to maintain the straw inside the container in an upright position.

7 Claims, 3 Drawing Sheets

FIG-1
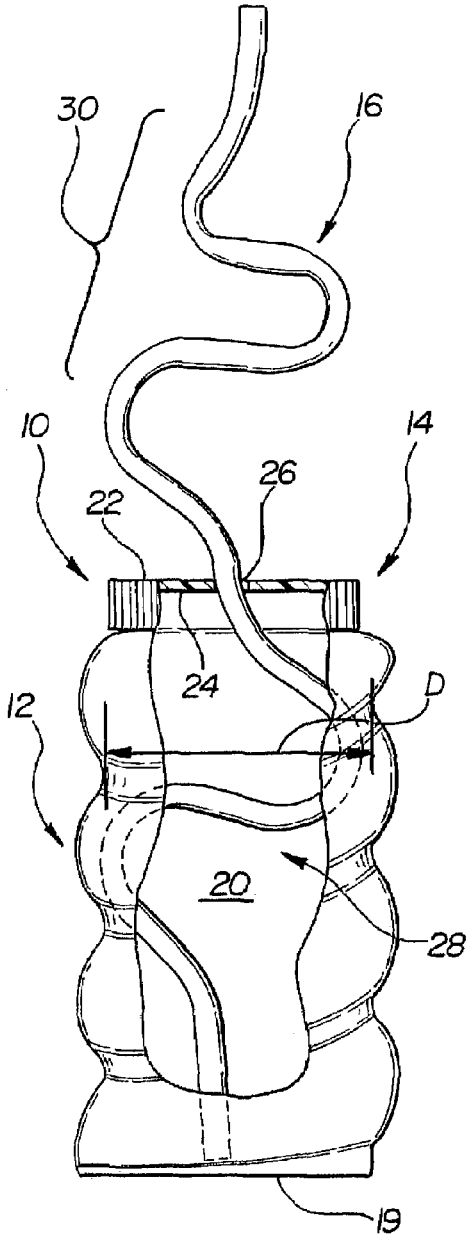
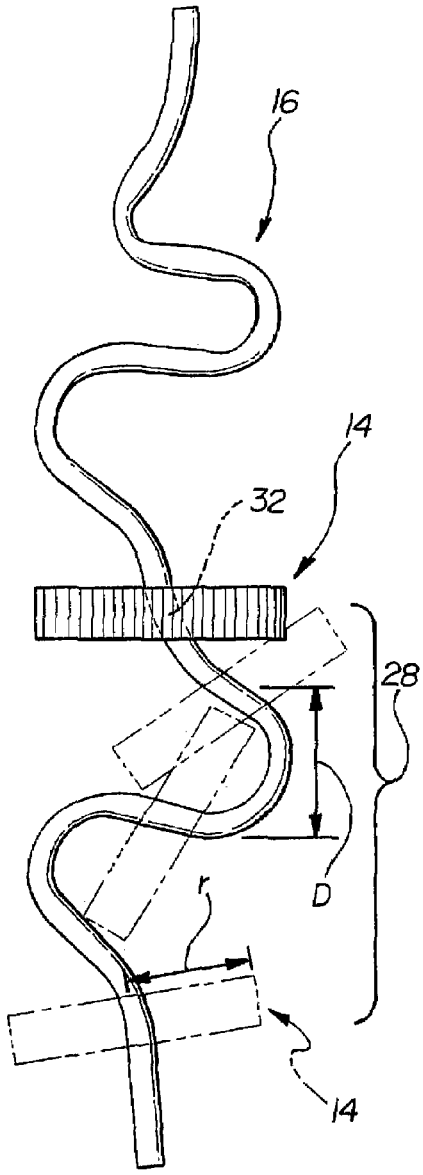
FIG-2

BEVERAGE CONTAINER WITH SELF-RETENTIVE STRAW

FIELD OF THE INVENTION

This invention relates to a beverage container having a lid and a straw and more particularly to a beverage container having a lid with a self-retentive straw that resists removal when the lid is attached to the container.

BACKGROUND OF THE INVENTION

It is known in the prior art to combine the concept of a drinking container and a drinking straw into one convenient device. Many such devices provide a novelty straw that has adequate utility for withdrawing liquid from a container but also includes non-utility aspects for amusing the consumer. In many cases, the novelty straw is what entices consumers to purchase the drinking container at the point of sale. As such, many retailers provide open shelf displays to make their drinking containers, having novelty straws included therein, readily accessible whereby consumers can conveniently select the containers they prefer. However, many retailers have suffered losses due to theft of the novelty straws from the containers thus requiring the purchase of additional straws or possibly the container and straw combination if they are not sold separately. Accordingly, a need exists for a combination beverage container and straw whereby a retaining means is provided that prevents the straw from being easily removed from the container.

The present invention provides a beverage container and straw device wherein a self-retentive straw is included that operates to resists removal of the straw from the container without the need of an additional retaining element. Additionally, the self-retentive straw is maintained within the container in an upright position.

SUMMARY OF THE INVENTION

The present invention provides a straw and beverage container combination wherein the straw and container interact to prevent the straw from being easily removed from the container without the use of a separate retaining means. Additionally, the straw is maintained inside the container in an upright position.

The straw and beverage container combination includes a container having an open end, a closed end and an interior cavity for receiving a beverage.

A container lid having a central aperture operates to fasten to the open end of the container such that the liquid is substantially contained within the container other than passage through the central aperture.

A self-retentive straw having retention means such as a convoluted portion adjacent one end is dimensioned to be slip fitted through the central aperture of the lid. In operation the straw is partially slip fitted through the aperture of the lid such that the convoluted portion is disposable into the interior cavity of the container while the second portion of the straw extends above the lid providing convenient access for sipping. After inserting the straw through the aperture in this manner, the lid is fastened to the container.

Combined in this manner the straw is substantially retained within the container in an upright position due to its interaction with the container walls and the lid. However, the straw is removable for cleaning, or replacing with a new straw, by carefully manipulating the lid to pass over the convoluted portion when separated from the container.

Additionally, the inventive straw may be used with conventional container and lid combinations wherein the container and lid are capable of receiving the straw in the manner described above.

BRIEF DESCRIPTION OF THE DRAWINGS

A better understanding of the present invention will be had upon reference to the following detailed description when read in conjunction with the accompanying drawings wherein like reference characters refer to like parts in which:

FIG. 1 is a view illustrating a preferred embodiment of the straw and beverage container combination including a cutaway view of the lid and container whereby the interior cavity of the container is exposed.

FIG. 2 is a view illustrating, in solid and phantom line, the lid being received onto the convoluted portion as according to the invention.

DETAILED DESCRIPTION OF THE PREFERRED EMBODIMENT

The present invention provides a straw and beverage container combination 10 wherein the straw is configured in a manner that prevents the straw from being removed from the container without first removing the lid from the container. Accordingly, the straw may be grasped as a means for carrying the container combination as well as providing a deterrent to a shoplifter seeking an easy score.

Figure 3:
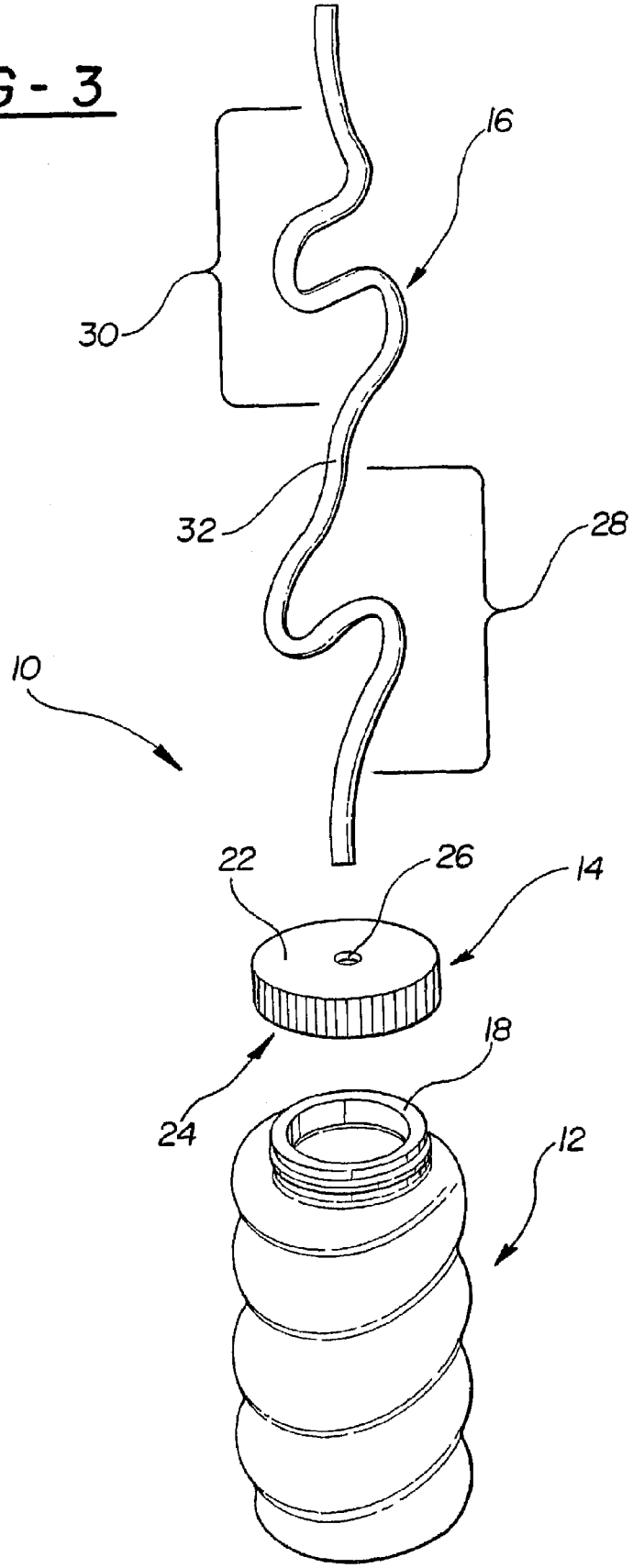
FIG. 3 illustrates an exploded view of the straw and container combination in detail.

The container combination 10 includes a container 12 that has an open end 18, a closed end 19 and an interior cavity 20 defined by the interior walls of the container 12. The container may take on a variety of shapes and sizes and thus the forms of the container shown in FIGS. 1 and 3 are merely illustrative.

A lid 14 having a central aperture 26, a top face 22 and a bottom face 24 operates to fasten to the open end 18 of the container 12.

A self-retentive straw 16 having a convoluted portion 28 adjacent one end is dimensioned for slip fit engagement through the central aperture 26 of the lid 14. As best illustrated in FIG. 2, the convoluted portion 28 is configured to allow the lid 14 to be received onto an intermediate portion 32 of the straw such that a first portion of the straw 30 extends and stands substantially straight above the top face of the lid and the convoluted portion or second portion of the straw extends below the bottom face of the lid.

Again referring to FIGS. 1 and 3, the convoluted portions 28 and 30 are merely illustrative and are not intended to limit the scope of the invention. However, it is important that the straw 16 has at least one convoluted or curvilinear portion adjacent one end to satisfy the objective of the invention.

Preferably, the at least one convoluted portion is serpentine or S-shaped in configuration such that the dimension (D) of the curved portions is greater than the radius (r) of the lid as best illustrated in FIG. 2. This ensures that the lid may be easily slip fitted onto the straw.

Operation of the invention will be better understood by referring to FIGS. 1 and 2 and the following description. First, the lid 14 is slip fitted onto the straw 16 through the central aperture 26 as best illustrated in FIG. 2. The lid may be slip fitted onto the straw over the first portion 30 if not limited by the convolutions configured in this portion, if any.

Preferably the lid is received onto an intermediate portion 32 of the straw such that a portion of the straw extends below the bottom face 24 of the lid 14 and a portion extends above the top face 22 such that a portion of the straw 16 provides convenient access for sipping.

Next, the convoluted portion 28 is disposed within the interior cavity 20 of the container 12 and the lid 14 is fastened to the open end 18 to seal the container.

As best illustrated in FIG. 1, the convoluted portion 30 stands substantially straight upward from the top surface 22 of the lid 24 whereby the user does not have to manipulate the straw 16 into position before sipping. Additionally, the portion 30 may serve as a handle for holding and carrying the container combination 10. The convoluted portion 28 extends substantially from the bottom face 24 of the lid 14 to the closed end 19 of the container 12. Preferably, the convolution portion 28 is configured such that the distance (d) between opposing curved portions of the convolution 28 is substantially equivalent to the diameter of the closed end 19 of the container 12.

Still referring to FIG. 1, it is apparent that if someone tries to remove the straw from the container by pulling on the portion 30 that extends above the lid 14 the convoluted portion 28 is dimensioned such that it is caused to abut against the interior walls and the lid 14 of the container 12 resulting in a retaining force that prevents the straw 16 from being easily removed from the container 12. This straw and beverage container combination provides an intrinsic retaining means that prevents the straw from being easily removed from the container while on display in a store without first removing the lid.

As best illustrated in FIG. 3, the straw 16 may have first 30 and second 28 convoluted portions wherein only the second convoluted portion 28 allows the lid 14 to be received onto the straw 16 through its central aperture 26. The first convoluted portion 30 is configured such that the lid 14 could not be passed onto the straw through its central aperture 26 thus providing only one way for the lid to be received onto the straw.

Figure 4:
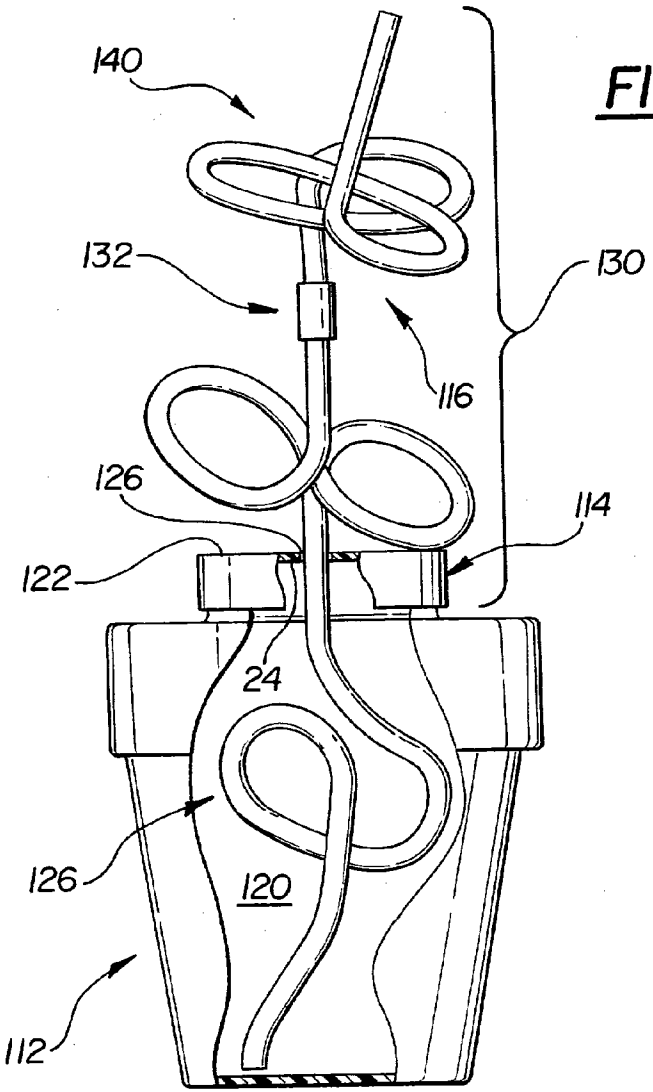
FIG. 4 is illustrates a second embodiment of a container and straw as according to the invention.

FIG. 4 illustrates a second embodiment of the invention wherein the straw 116 and container 112 have different structural characteristics but are designed to function in the same manner as the above described embodiment. In this case, the container 112 is substantially in the form of a flower pot closable with lid 122, while the straw 126 includes a substantially knotted portion 128 disposed at one end. The knotted portion 128 prevents the straw from being easily removed from cavity 120 without first removing the lid 112. It should become apparent that other structural characteristics of the straw and container may be used to meet the objective of the present invention.

In addition, the straw 116 includes a second end 132 in the form of a connector which attaches to second straw 110 configured in the form of a flower. Alternatively, the flower could be formed by extending the straw 116.

Figure 5:
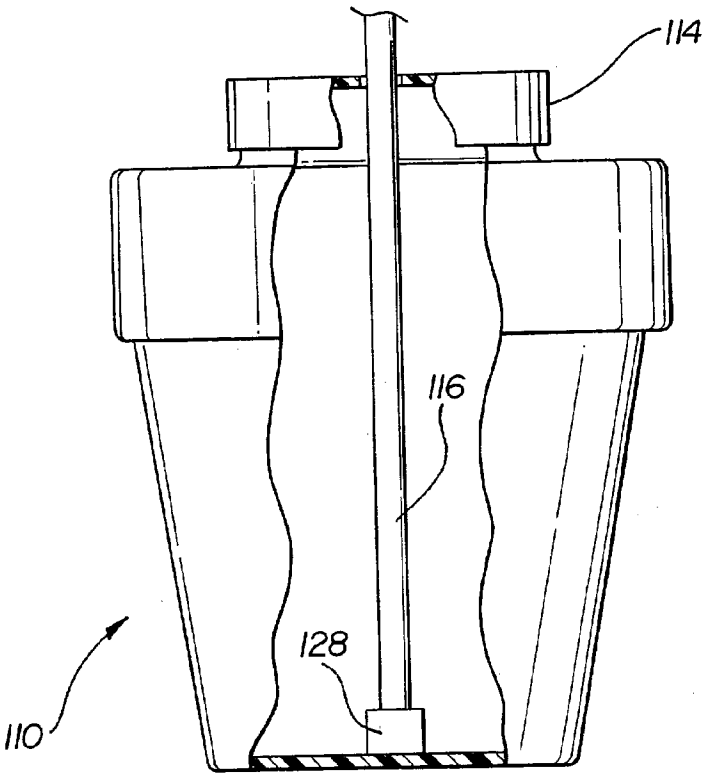
FIG. 5 is a detailed view of the embodiment of FIG. 4 having an alternate retention means.

In the FIG. 4 embodiment, the knotted portion 126 serves two functions. It prevents the straw 116 from being removed from the container 112 as long as lid 122 remains secured thereonto; and it holds straw 116 upright in the container both for display purposes, and so that the straw 116 may more easily be sipped from. Alternatively, the knotted portion 126 could be eliminated, and the straw 116 provided with a connector 128 (FIG. 5) fastened to the bottom of the container 112 by glue or similar means, thus retaining the straw 116 in the container 112 and keeping it upright. Alternatively, the connector 128 could simply be fastened to the straw 116, thus permitting some movement of the straw with the container, but still making it difficult to remove therefrom. Alternatively, the straw 116 could simply be glued to the lid 114.

Each of the straw, lid and container may all be made of plastic or other material known to those skilled in the art. Additionally, the straw 16 may be made of a transparent plastic material that includes a color tint as a decorative feature.

From the foregoing it can be seen that the present invention provides a simple straw and container combination for use as a novelty item for drinking beverages. Although the invention has been described with respect to certain exemplifications and embodiments thereof, many modifications thereto may become apparent to one of skill in the art without deviation from the spirit of the invention as defined by the scope of the appended claims.

I claim:

1. A self-retentive straw and beverage container combination, said combination comprising:

a beverage container having a closed end, an open end, an interior wall and an interior cavity;

a container lid having a central aperture, said lid operates to fasten to said open end of said container; and a self-retentive straw having:

an intermediate portion having a first end and a second end;

a first convoluted portion extending from said first end of said intermediate portion; and a second convoluted portion extending from said second end of the intermediate portion, said second convoluted portion configured to allow the lid to be received onto the intermediate portion, the interior wall being contoured so that the width of the cavity as measured along a line normal to an axis extending from the closed end to the open end varies as a function of the distance from the closed end; whereby the second convoluted portion abuts against diametrically opposed sections of said interior wall of the container to prevent the straw from being easily removed from the container when the straw is installed into said interior cavity of the container and the lid is attached to the container while permitting the straw to be readily removed when the lid is not attached to the container.

2. The straw of claim 1 wherein said first convoluted portion is configured to prevent said lid from being received onto the first convoluted portion.

3. The straw of claim 1 being made of tinted transparent plastic material.

4. The straw of claim 1 wherein the convoluted portion is serpentine or S-shaped.

5. The straw of claim 1 wherein the convolution has an expanse substantially equivalent to the diameter of said closed end.

6. The straw of claim 1 having a portion that stands substantially straight upward from said top surface of said lid.

7. The straw of claim 1 wherein the convoluted portion includes curved portions having curvilinear dimensions.

* * * * *